US005215264A

United States Patent [19]

Lynn C. Lundquist

[11] Patent Number: 5,215,264

[45] Date of Patent: Jun. 1, 1993

[54] CONVEYING AND PROCESSING APPARATUS FOR VEHICLE MOUNTED SIZE REDUCTION EQUIPMENT

[76] Inventor: Lynn C. Lundquist, 10833 NE. Russell, Portland, Oreg. 97220

[21] Appl. No.: 636,594

[22] Filed: Jan. 2, 1991

[51] Int. Cl.[5] ..... B02C 23/04; B02C 21/02

[52] U.S. Cl. ..... 241/37.5; 241/101.7; 241/189.1; 241/235; 241/285.2; 241/DIG. 38

[58] Field of Search ..... 241/97, 98, 99, 37.5, 241/101.7, DIG. 38, 186 R, 101.2, 236, 235, 285.1, 285.2

[56] References Cited

U.S. PATENT DOCUMENTS

| | | | |
|---|---|---|---|
| 602,221 | 4/1898 | Jessen | 241/101.7 X |
| 2,554,071 | 5/1951 | Strawn | 241/285 A |
| 3,868,063 | 2/1975 | Slaker | 241/101.7 |

FOREIGN PATENT DOCUMENTS

| | | | |
|---|---|---|---|
| 2003681 | 8/1971 | Fed. Rep. of Germany | 241/101.7 |
| 2017352 | 10/1971 | Fed. Rep. of Germany | 241/285 A |
| 2845447 | 4/1980 | Fed. Rep. of Germany | 241/236 |
| 2905906 | 8/1980 | Fed. Rep. of Germany | 241/236 |
| 142123 | 6/1980 | German Democratic Rep. | 241/101.7 |
| 835487 | 6/1981 | U.S.S.R. | 241/285 A |

*Primary Examiner*—Timothy V. Eley

[57] ABSTRACT

This invention pertains to an apparatus which facilitates the curb-side collection of recyclable waste products. It does so by incorporating a size reduction cutting or crushing head into a mobile unit designated primarily for truck mounting. The conveying and processing apparatus further provides a means whereby said recyclable waste products can be conveniently fed into the unit at a location, or multiple locations, convenient to an operator, or multiple operators, during said collection procedure. The apparatus provides the conveying and processing equipment necessary to move said recyclable material from the feed location to a size reduction cutter or crusher head mounted centrally to any such conveying components. Upon completion of the size reduction stage, the unit further provides the means of holding the processed recyclable material prior to its discharge at a collection facility. The invention is concerned with the mounting means of said cutter or crusher head in order to provide a means of rapid installation and removal for either the purpose of maintenance or that of a change of waste material function for the mobile mounted apparatus. Simplicity of general operation and maintenance of the apparatus are also concerns addressed by this invention.

14 Claims, 4 Drawing Sheets

CONVEYING AND PROCESSING APPARATUS FOR VEHICLE MOUNTED SIZE REDUCTION EQUIPMENT

BACKGROUND—FIELD OF THE INVENTION

This invention provides an apparatus which facilitates the curb-side collection of recyclable waste products. It does so by incorporating a size reduction cutting head into a mobile unit designated primarily for truck mounting. The conveying and processing apparatus further provides a means whereby said recyclable waste products can be conveniently fed into the unit at a location, or multiple locations, convenient to an operator, or operators, during said collection procedure. The apparatus provides the conveying and processing equipment necessary to move said recyclable material from the feed location to a size reduction cutter or crushing head mounted centrally to any such conveying components. Upon completion of the size reduction stage, the unit further provides the means of holding the processed recyclable material prior to its discharge at a collection facility.

BACKGROUND—DESCRIPTION OF THE PRIOR ART

With the recent advent of curb-side collection of recyclable consumer products, of which plastic is a primary concern, various of means of collecting and transporting such materials have been developed. (Curb-side collection generally refers to waste collection in situs within residential areas.) Initially, and still the method of most frequent use, is that of designated collection bins mounted on a truck body. Each designated bin is assigned a specific recyclable material function such as plastic, cardboard, newsprint, or the like. In almost all cases, the material is thrown into the bin through an opening with no attempt at size reduction or primary processing before the material is transported to a reprocessing facility.

It should be obvious that, for those materials which are hollow (such as plastic bottles) or of irregular shape (such as cardboard and the like) such a collection procedure poorly utilizes the bin space. It should be further obvious, that a remedial attempt on the part of the operator to carefully sort material such as cardboard or containers to better utilize space significantly impedes the collection function.

As a partial answer to the dilemma of space utilization while in transport, both compacting and course shredding have been attempted. In the case of compacting, the material is fed into a crusher mounted on the truck body which compacts or bales the material, thus reducing the volume required for its transport. Shredding the material better accomplished this need in that the material may be evenly distributed in a bin with greater density.

Mobile shredding as done until now, nonetheless, has the disadvantage of using equipment which is maintenance intensive, causing the entire truck to be removed from service for prolonged periods when repairs are needed. Shredding equipment is often bulky and heavy, adding substantially to the weight of the vehicle. Shredding equipment may reduce volume for profitable transportation, but it is seldom sufficient as the final size reduction step for final processing of the material. Finally, shredding is often sufficiently noisy in operation to make it objectionable in residential areas.

Most of the problems encountered with mobile shredding systems are design limitation inherent in the actual shredding equipment itself. In a companion patent application entitled CUTTER ENHANCEMENT FOR PLASTIC SIZE REDUCTION EQUIPMENT, Ser. No. 07/595,258, a design has been set forth which addresses these limitations. In that application, a cutter head assembly is described which is small in size, can be quickly disengaged from the complete unit, is quiet in operation, and provides a uniform chip which is suitable for final processing.

In its preferred embodiment, this present invention is the conveying and processing apparatus which will be used with the cutter head of the afore mentioned patent application.

It is thus, a primary objective of this invention to overcome those disadvantages and limitations presently found in mobile shredding equipment, particularly in that equipment which is used in curb-side collection of waste material for subsequent reprocessing. As will be seen in the following material, however, this invention has multiple objectives and is in no way limited to this single statement of purpose.

Thus, it is the intent to support this invention as being novel as compared with the prior art and as offering the end user significant utilitarian advantages.

OBJECTIVES OF THE INVENTION

This invention was developed with an understanding of the limitations of the previously described mobile or vehicle mounted solid waste recovery equipment. Furthermore, it was designed with a number of other objectives considering its potential application.

1. It is the general objective of this invention to provide a vehicle mounted conveying and processing apparatus which accommodates a certain described cutter head for plastic materials as the waste material size reduction means.

2. Another objective of this invention is to provide a vehicle mounted conveying and processing apparatus which accommodates other cutter or crusher heads for similar or interchangeable waste size reduction use.

3. Another objective of this invention is to provide conveying systems for a waste material to the cutter or crusher head on both sides of the unit to facilitate collection from either side of a roadway.

4. Another objective of this invention is to provide a conveying system for a waste material to the cutter or crusher head from a single operator position.

5. Another objective of this invention is to design the conveying and cutter head mounting structure in modular form so that it can be rapidly installed or removed from the material holding bin for service.

6. Another objective of this invention is to provide a means of viewing and distributing the load inside the material receiving bin from an outside operator position.

7. Another objective of this invention is to provide a means of material distribution within the material holding bin with a constantly engaged power auger.

8. Another objective of this invention is to achieve the space savings inherent in a steeply inclined conveyor with a undershot conveyor belt feed system in conjunction with a conveyor flight chute.

9. Another objective of this invention is to achieve the space savings inherent in a steeply inclined conveyor with a stationary belt methodology and a door system which forces material into a feed section.

10. Another objective of this invention is to provide a return path for stray material which will prevent jamming and cause it to recirculate to the feed section.

11. Another objective of this invention is to provide a mounting means for the cutter or crusher head which allows rapid removal and replacement of said cutter or crusher head during routine or emergency service.

12. Another objective of this invention is to provide a sliding clamp mounting means for said cutter or crusher head which requires only the loosening of two fasteners for complete implementation and which is manipulated solely from the cutter or crusher head removal position.

13. Another objective of this invention is to design the motor drive unit in modular form so that it can be quickly installed or removed from its supporting structure for service.

14. Another objective of this invention is to design the motor drive unit so that all drive gear backlash adjustments to said motor drive gear are accomplished by manipulating only the drive unit assembly mounting plate.

15. Another objective of this invention is to design the motor drive unit so that all hydraulic equipment and speed monitoring devices are integral to said modular unit.

16. Another objective of this invention is to provide a simplified means of drive and conveyor component removal which does not require extensive disassembly of unrelated parts.

17. A final objective of this invention is to provide an assembly location for a linked conveyor belt which does not necessitate disassembly of the conveyor belt housing for belt installation.

These and other objectives and advantages of the present invention, and the manner in which they are achieved, will become apparent in the following specifications and claims.

SUMMARY OF THE INVENTION

In its preferred embodiment, the present invention is a truck mounted apparatus with a waste material size reduction cutter head centrally located in the discharge area of two conveyor belt systems. The granulated discharge from the cutter head falls downward into the receiving area of the material holding bin surrounding the enclosed conveyor housings. The material is subsequently discharged from the material holding bin at a central material processing location.

The apparatus is preferably mounted on a truck bed in such a location that the conveyor belts' direction of travel is from either curb-side of the truck bed to the center line of the bed. Thus, waste materials, most notably plastic bottles and the like, can be placed into the feed area on either side of the truck body. From either feed area, these materials are conveyed upward, and toward the center line of the truck body, where they fall from the top of their respective conveyor belt. Upon dropping from the conveyor, the waste material falls into a crammer. Said crammer is composed of two counter rotating paddles which simultaneously crush and force-feed the waste material into the cutter head cutting chamber.

Particular attention has been given in the design to eliminate material falling from, or jamming, the conveyor belt system. In the preferred embodiment, an undershot conveyor system has been devised which carries the waste material on the underside of the belt, sweeping it up an inclined conveyor flight chute. This arrangement results in a better transition from the conveying portion to the feeding portion (that is, the crammers) of the equipment. It has the further advantage of lowering the feed area of the unit relative to the operator position.

In a second embodiment, a conventional overshot conveyor belt design is employed. Because the belt is operating at approximately a twelve degree incline from the vertical, a first stationary belt is provided against which the flights of the conveyor interact. This interaction between the flights and the stationary belt assures that material will be carried on the conveyor in spite of the angle of assent. Further, materials with a dimension greater than the flight depth can be carried by the conveyor. In some instances, material may fall from the conveyor outside of the crammers. For this eventuality, the return side of the conveyor is enclosed so that such material will remain in communication with the conveyor and be carried by its flights on the return path. Additionally, a second stationary belt encloses the flights at the bottom of the conveyor unit so that said return material will be again conveyed to the feed area of the unit. The stationary belts are tensionably mounted so that while maintaining communication with the tops of the flights, waste materials with a dimension greater than the flight height may pass along the conveyor path unencumbered.

Great attention has been given to the design of the apparatus to assure ease and speed of maintenance. As will be shown latter, many portions of the apparatus employ a modular concept so that sections of the apparatus may be removed as units thus avoiding undesirable disassembly. Most notably, the cutter head assembly is removable by nothing more than the disengagement of two locking nuts and clamps. The entire conveyor and processing unit may be removed from the material holding bin by loosening a limited number of fasteners and hoisting the unit from said bin. In addition, where sub-assemblies which may require periodic maintenance are located behind structural members and the like, said sub-assemblies are mounted so that they are assessable by removing inspection plates rather than requiring disassembly of a structural member.

A second embodiment of this same apparatus may be similarly constructed with a single conveyor belt. In this case, the single conveyor, crammers, and cutter head arrangement would remain as previously indicated. However, the unit would now be fed from only a single side of the truck bed.

This conveying and processing apparatus is in no way limited to plastic waste collection and processing. The removable cutter head section is so designed that cutter or crusher heads for diverse materials may be interchanged giving a wide range of application to the single apparatus. For example, with the substitution of a paper shredding cutter head, fibrous materials such as paper or cardboard could be processed in the same unit. Other options exist with metal can crushing heads, glass crushing heads, and the like. In some cases, the crammers would also be changed to accommodate another material. This has been anticipated by providing a crammer cover plate system which allows the crammers to be removed with minimal disassembly.

DESCRIPTION OF THE PREFERRED EMBODIMENTS

Figure 1:
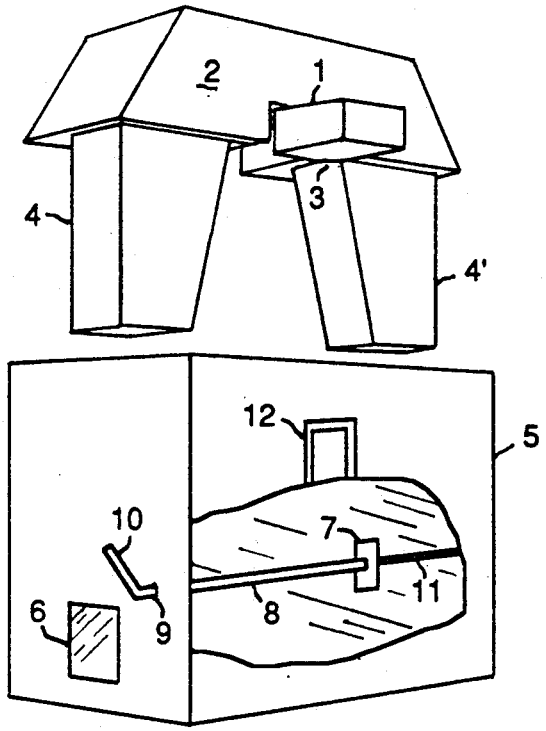
FIG. 1 is a perspective view of the preferred embodiment of the conveying and processing apparatus showing the cutter head nesting into the power section and the conveyor housing sections which in turn nests into the material holding bin.

To simplify the description, symmetrical parts, or portions of a single part where divided by a sectional view, will be designated with a prime (′). The description of the part(s) having primed reference characters will be limited to a minimum.

Referring now to FIG. 1, the concept of the preferred embodiment is shown in an assembly view where the cutter head 1 is shown nesting into the power section 2 which contains the drive motor and mechanical linkages (which will be shown in later figures). Not shown for sake of clarity is a rail mounting system extending from the power section 2 at 3 which supports the cutter head 1 in both its operating position and during removal. Extending downward from, and attached to the power section 2, are symmetrical conveyor housing 4 sections. In the preferred embodiment, these sections each contain a conveyor belt, a conveyor flight chute, and the conveyor belt tensioning means, all of which will be shown in succeeding figures.

The entire power section 2 and conveyor housing sections 4, when assembled as a unit, may be removed from the material holding bin 5 as a complete assembly. When lowered into the operating position, the feed area of the conveyor housings 4 are in alignment with the feed inlet 6.

A movable paddle 7 is mounted inside the material holding bin 5 which allows the operator to level any undesirable mounding of material within the material holding bin 5. Said paddle 7 is intimately mounted to a movable hollow paddle tube 8 which extends through the bin wall at 9 and is joined to a paddle handle 10. The paddle tube 8 is slidably positioned on a stationary paddle tube locating rod 11 which restricts the paddle tube 8 motion to the plane of said stationary paddle tube locating rod.

Material sight windows 12 are located on the material holding bin 5 wall which allow the operator to monitor the slope of the material within said bin, and to determine the load condition. In the preferred embodiment, a movable paddle 7 system is located inside the material holding bin 5 on both sides of the conveyor housing 4 sections.

Figure 2:
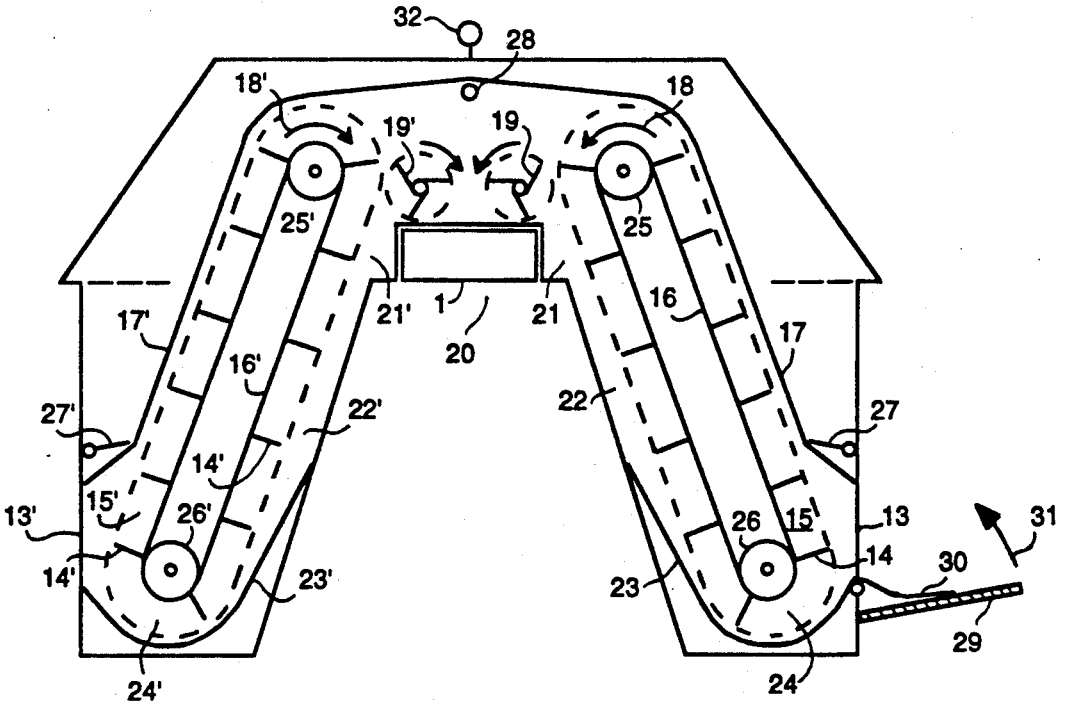
FIG. 2 is a front sectional elevation view of the entire unit showing the conveying, cramming, and cutter head functions.

FIG. 2 illustrates the conveying and processing mechanisms of one embodiment. Waste material is fed into the apparatus at 13, and is carried between the conveyor flights 14 at 15. As material is carried up the conveyor belt 16, it is held in position on the conveyor by the upper stationary belt 17 along its vertical travel. At the upper limit of conveyor belt travel 18, the material is carried into the crammers 19 which crush the material and force-feed it into the cutter head 1. As the material is processed, it is discharged from the cutter head 1 at 20. In the event that some small percentage of material is not properly carried into the crammers 19, and falls into the area at 21, it will recirculate back through the return side 22 of the conveyor. Said material would come into contact with the lower stationary belt 23, and be carried between the flights at 24 to the feed area 13 at which it will recirculate.

The conveyor belt 16 is mounted between an upper drive pulley 25 and a lower idler pulley 26.

The upper stationary belt 17 is tensioned by a spring loaded tensioning paddle 27 on each extremity of said upper stationary belt. The upper stationary belt 17 rides on the conveyor belt flights 14 and is slidably positioned above the crammers 19 by a roller shaft 28 assembly.

A door 29 assembly is lowered to provide a loading platform. The lower stationary belt 23 slidably extends over said door assembly at 30. When the door 29 assembly is closed as indicated by 31, material on the door 29 assembly and lower stationary belt portion 30 is forced into the moving conveyor belt flights at 15.

A hoisting eye bolt 32 is position at the horizontal center of gravity for use in lifting the assembled apparatus from the material holding bin 5.

Figure 3:
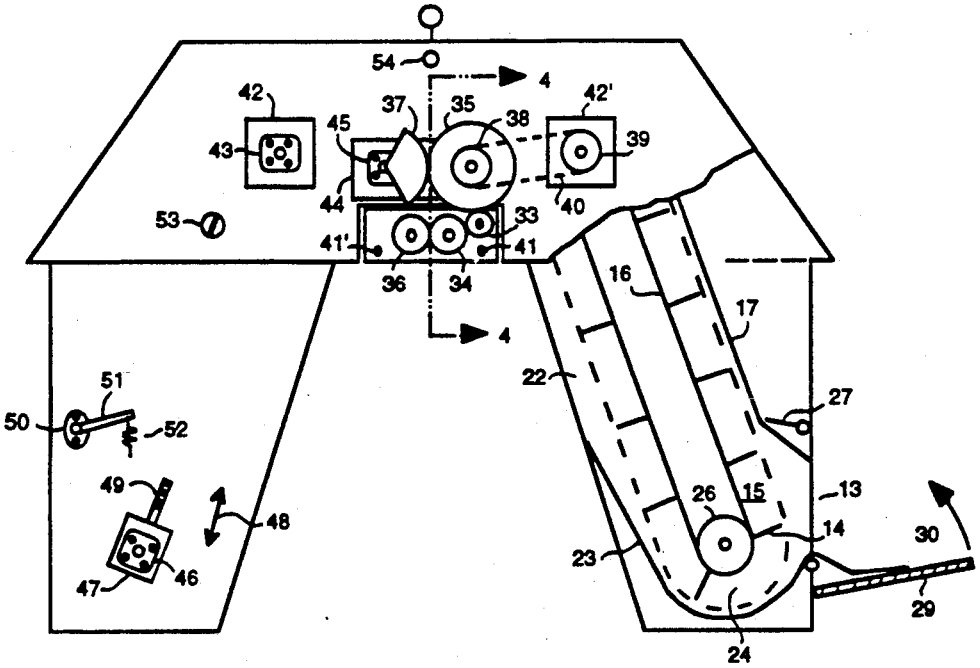
FIG. 3 is a front elevation and partial cut-away view showing the drive system.

FIG. 3 is a cut away view showing the drive, belt tensioning and related external details of the assembly which is shown in FIG. 2. Pertaining to the drive mechanism, a motor drive spur gear 33 is positioned against the cutter head drive gear 34 and the crammer drive gear 35. Thus, the counter rotating shafts of the cutter head 1 are driven by the cutter head drive gear 34 and the cutter head driven gear 36, whereas the crammers 19 are driven by the crammer drive gear 35 and the partially shown crammer driven gear 37. By this arrangement, the respective crammer and conveyor pulley drive and driven gears are turning in the same direction of rotation. In practice, the motor drive spur gear 33 is a 27 tooth gear, the cutter gears 34 and 36 are 40 tooth gears, and the crammer gears 35 and 37 are 80 tooth gears. A conveyor belt drive sprocket 38 drives the conveyor drive pulley sprocket 39 by means of a conveyor sprocket chain 40. A similar drive chain arrangement for the second conveyor is provided on the crammer driven gear 37 shaft, though it is not shown in order to avoid excessive detail. With this arrangement, the conveyor belt drive pulley 25 or 25′ and its respective crammer 19 or 19′ (as shown in FIG. 2) rotate in the same direction. Further, the drive sprocket 38 and/or the conveyor drive pulley sprocket 39 may be changed to alter the speed ratio between the cutter head 1 and the conveyors 16 or 16′. In practice, a drive-to-driven ration of 1:1.125 has been successfully used.

Figure 4:
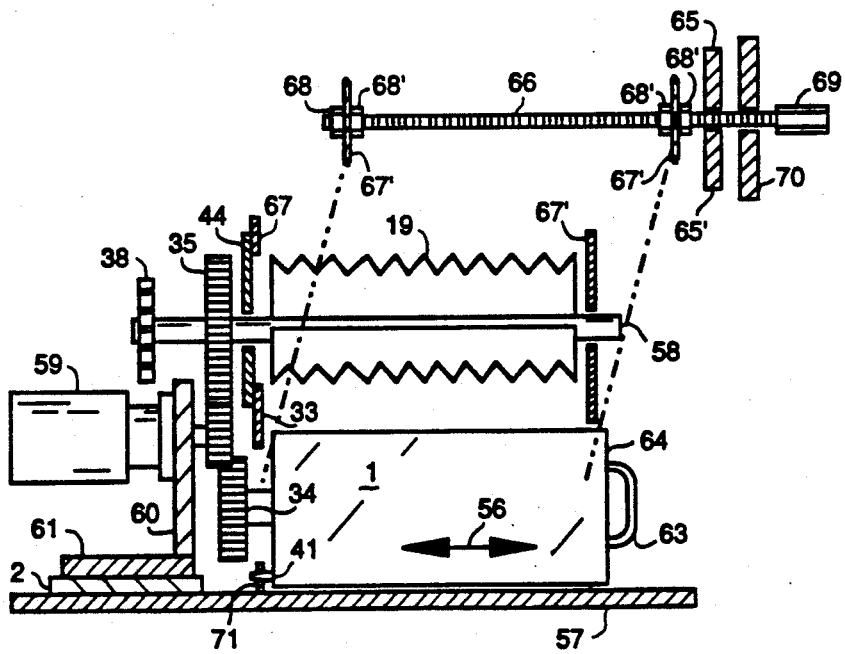
FIG. 4 is a side elevation view of the drive motor, movable cutter head, crammer, connecting gear train, and locking means.

FIG. 3 also demonstrates a novel feature of this drive system which will be further shown in FIG. 4. It should be apparent that inasmuch as all gearing utilizes straight cut spur gears, that the entire cutter head 1 assembly can be slidably removed from, or replaced in contact with, the motor drive spur gear 33 with no disassembly or alteration in the location of either unit. To facilitate location of the cutter head 1 in relationship to the motor drive spur gear 33, cutter head locating pins 41 are shown which align the cutter head 1 with the stationary body of the apparatus. (Further details regarding the locating pins 41 and 41' will be give in the description of FIG. 4.)

Upper conveyor pulley cover plates 42 are used so that they serve the dual purpose of providing an upper conveyor pulley bearing 43 mounting surface, as well as covering an opening which is sufficient for removal of the upper conveyor drive pulley 25 when necessary. Thus, the upper conveyor drive pulley 25 may be removed from the apparatus with only minimal disassembly. In a similar manner, a crammer cover plate 44 is employed which allows removal of either crammer 19, or the entire assembly, with only minimal disassembly. The crammer shaft bearings 45 are also mounted to the crammer cover plate 44. (Cover plates are not used on the opposite shaft side. The flange bearings are directly mounted to the power section 2 structural members.)

An adjustable lower conveyor pulley bearing 46 is used to tension the conveyer belt 16. The bearing is mounted on a bearing plate 47 which separates the contents on either side of the conveyor housing 4 from co-mingling through the slotted areas provided for sliding fasteners (which is not shown). Conveyor belt adjustment movement 48 is obtained by manipulating a threaded body 49 which is, on its one extremity, mounted to the conveyor housing 4, and on its other extremity, to the bearing plate 47.

A tensioning paddle shaft bearing 50 is shown which accommodates the rotational movement of the tensioning paddle 27. Adjustable tension is maintained on said shaft by means of a paddle control arm 51 and a paddle control spring 52 which may be attached at any of a plurality of drillings in the control arm 51.

A link pin hole 53 is provided on the power section 2 bulkhead which allows the insertion or removal of a belt link pin. Thus, the conveyor belt 16 may be removed without the necessity of removing any structural members of the apparatus.

A drilling at 54 accommodates the roller shaft 28 assembly shown in FIG. 2.

A lower stationary belt support 55 is used to shape the lower stationary belt 23 around the bottom arc of the conveyor belt flights 14. Thus forming the conveyor belt allows material to be properly carried back to the feed area 13 rather than dropping to the bottom of the conveyor housing 4. In practice, this support 55 member may be comprised of a tensioned spring which allows the lower stationary belt 23 to deflect if a large item is recirculated through the lower portion of the conveyor system between the flights at 24.

FIG. 4 illustrates the drive assembly wherein the cutter head 1 is slidably removed from its mounting area. This removal method is achieved in part by aligning a straight cut motor drive spur gear 33 with a meshing cutter head drive gear 34 which disengages by sliding the cutter head 1 assembly away from the drive spur gear 33 in a plane as indicated at 56. This removal method is further achieved by providing a rail mounting 57 which supports and locates the cutter head 1 as it is slid in, and out, of position, and cutter head locating pins 41 which secure said cutter head into a fixed position in relationship with the motor drive spur gear 33. The locating pins 41 communicate with properly positioned holes in the body of the apparatus.

The drive train to other moving parts is achieved by simultaneously meshing the motor drive spur gear 33 with the crammer drive gear 35. As indicated in FIG. 4, the crammer drive gear 35 is on a common shaft 58 with the crammer 19 and the conveyor drive sprocket 38. By referring to FIG. 3, it should be apparent that both crammers 19 and both conveyor systems through their respective drive sprockets 38 are powered through this drive train.

FIG. 4 further shows the preferred mounting means for a hydraulic motor drive, with a face plate mounted hydraulic motor 59 mounted on a motor mounting bracket 60. The motor mounting bracket base 61 is secured to the rail mounting 57 with through bolts (not shown) in elongated slots. Further, the distance between the motor mounting bracket 60 and the rail mounting 57 can be adjusted with a shim plate 62 of any appropriate thickness. Thus, gear backlash adjustment between the motor drive spur gear 33 and the crammer drive gear 35 and cutter head drive gear 34 (both of which have a fixed location relative to the motor drive spur gear 33 while in operation) can be achieved during initial installation. That is, the motor drive spur gear 33 may be moved in both a horizontal and a vertical plane to achieve proper spacing relative to said driven gears.

The motor mounting bracket base 61 is further used as the mounting area for the hydraulic solenoid valve, hydraulic pressure relief valve, hydraulic pressure gage, and rotational monitoring equipment.

In some cases, a handle 63 or other leverage means may be added to the cutter head 1 assembly to ease removal of said cutter head from its operational location.

The removable cutter head 1 unit is secured to the power section 2 of the apparatus by clamping said cutter head at 64 with the cutter head clamp 65. A threaded rod 66 (shown offset from its exact location) extends between the two bulkheads 67 of the power unit 2, and is secured to said bulkheads by appropriate fasteners 68. Thus, the clamping force of the clamp nut 69 is transmitted to the clamp plate 70, through the threaded rod 66 and to the bulkhead 67 which is locating the cutter head 1 at 71 by means of the cutter head locating pins 41.

Figure 5:
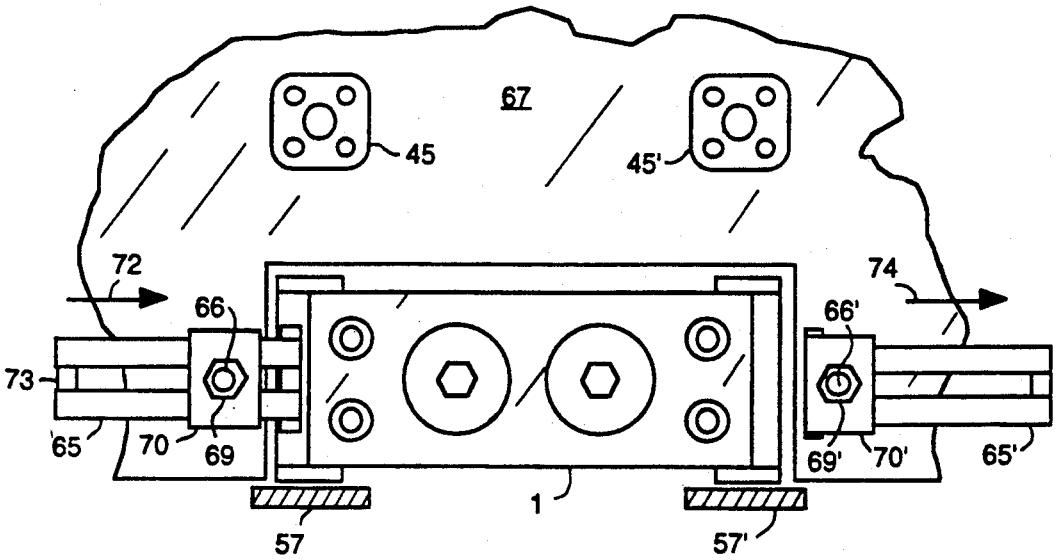
FIG. 5 is a front elevation view of the cutter head locking means.

FIG. 5 shows a view of the clamping system used on the cutter head 1 assembly. The clamping system is located on the opposite end (as indicated by location 64 shown in FIG. 4) of said cutter head from the cutter head drive gear 34 and related drive components. In use, when the cutter head clamp 65 is moved into the clamping position as indicated by 72, the clamping force is transmitted through the threaded rod 66 which is immovably mounted to both bulkheads 67 of the power unit 2. When the clamp nut 69 is tightened, the compressive force is transmitted to the clamp plate 70 and subsequently to the cutter head clamp 65. The primary clamping force is directly against the cutter head 1 proper. The supporting clamping force is at the tail of the clamp 65 at 73.

When the clamp nut 69 is loosened, the cutter head clamp 65 may be positioned clear of the cutter head 1 as indicated by 74. With both clamps released in this second position, the cutter head 1 may be freely removed from the power unit 2 on the guide rail mounting 57.

The handles 63 of FIG. 4, are not shown in FIG. 5.

Figure 6:
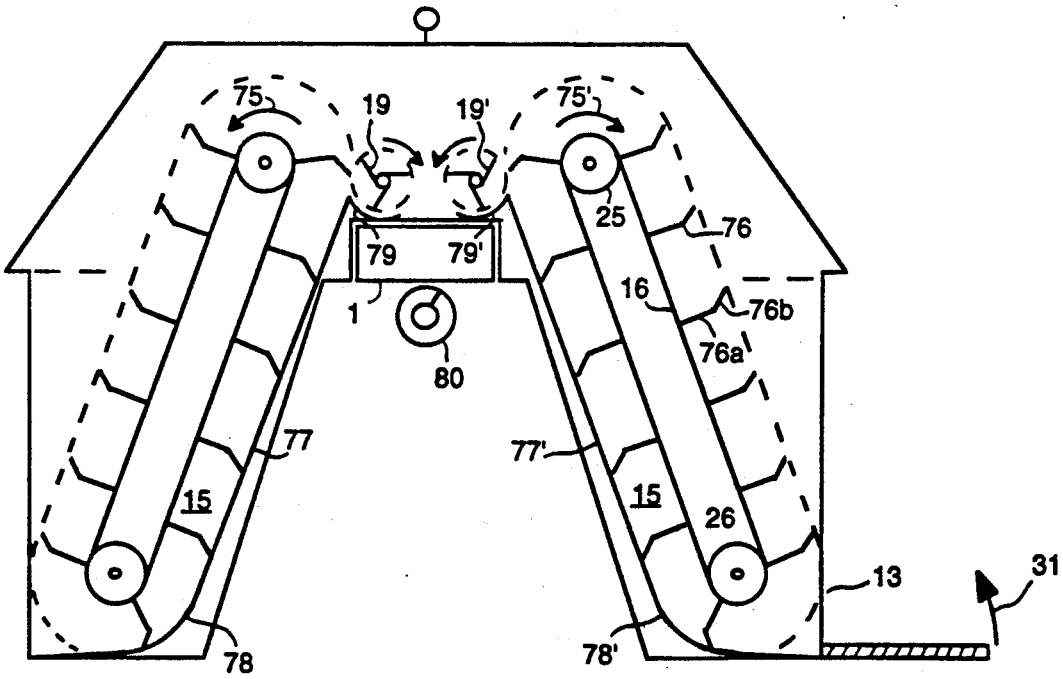
FIG. 6 is a front sectional elevation view of the preferred conveyor embodiment showing the conveying, cramming, and cutter head functions.

FIG. 6 indicates the preferred conveyor belt embodiment. In this embodiment, the conveyor belt 16 and crammer 19 locations are similar. However, the conveyor belt 16 rotates in a reverse direction as indicated by arrows 75 providing an undershot conveying system. The conveyor belt flights 76 are articulated, having a relatively rigid member 76*a* adjacent to the conveyor belt 16 and a flexible member 76*b* on the outer section. A semi-rigid material (usually ultra-high molecular weight [UHMW] polyethylene) is used as a conveyor flight chute 77. The conveyor flight chute 77 conforms to the conveyor belt flights 76 at 78 and extends to the door opening. Material is carried between the conveyor flights 76 and the conveyor flight chute 77 at 15 until it is discharged at the top of the conveyor belt travel. A stationary crammer shield 79 is mounted rigidly to the body of the power section 2 and the conveyor flight chute 77 so that material has no alternate path other than over the crammers 19.

A material distribution auger 80 may be located under the discharge area of the cutter head to distribute the processed material evenly within the material holding bin 5.

Figure 7:
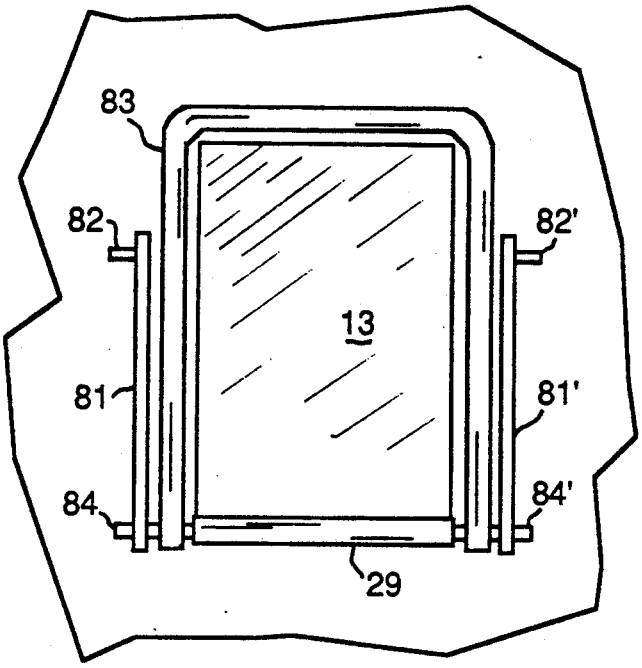
FIG. 7 is a side elevation view of the door safety crash bar system.
Figure 8:
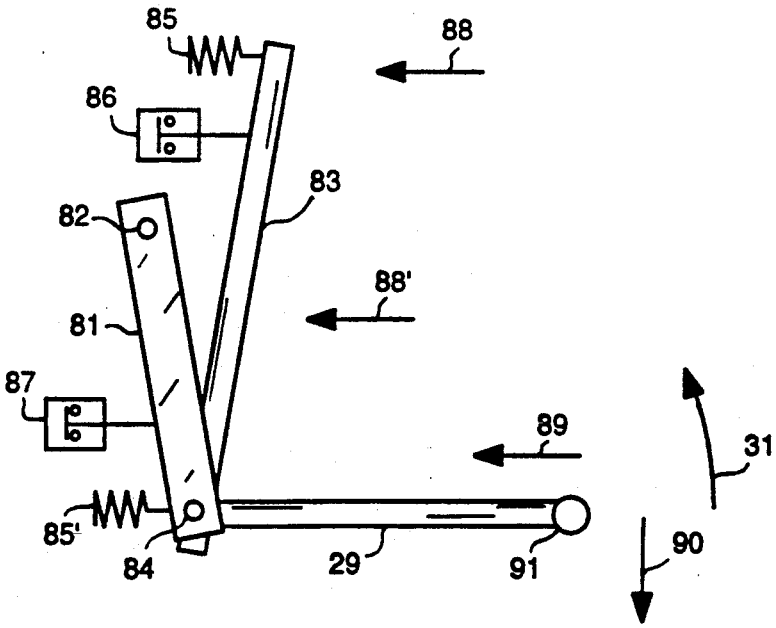
FIG. 8 is a front elevation of the door safety crash bar system.

FIG. 7 together with FIG. 8 show the operator safety provisions used in conjunction with the door 29 assembly and feed opening 13. A swing bar 81 is mounted to the material holding bin 5 with a pivot 82 so that the door 29 and crash bar 83 are hinged at 84. With this mounting provision, the crash bar 83 or the door 29 may be independently pushed against the two return spring 85 areas. This motion, in conjunction with a crash bar safety switch 86 or a door safety switch 87 can be used as an emergency stop. Thus, any horizontal motion 88 against the crash bar 83 or horizontal motion 89 or vertical motion 90 against the door 29 becomes an effective safety shut-down action. To further prevent injury, a blunt or padded bull nose 91 is located on the front portion of the door 29. Said door is free to close as indicated by 31 without activating the safety shutdown.

OPERATION

In one embodiment, as illustrated in FIG. 2 and FIG. 3, the operator lowers the door 29 assembly and uses its upward facing surface as a loading area. Materials may be forced directly through the feed area at 13 by hand, or the door may be used as a crammer when it is shut as indicated by 31 which forces the material between the ascending conveyor belt flights at 15. As the material is carried on the conveyor, it passes under the spring loaded tensioning paddle 27 and into the area covered by the upper stationary belt 17. The tensioning paddle maintains a minimal tension on the upper stationary belt 17 at all times, yet allows large sized materials to pass through its controlled area. Thus, by this means, materials are prevented from falling from the flights irrespective of the steep angle of assent of the conveyor system. At the upper limit of conveyor belt travel 18 the material is carried into the crammers 19 and force-fed into the cutter head 1 assembly.

In order to avoid extreme complexity of the conveyor system at its upper limit of travel 18, the conveyor track is so designed that it is permissible for a small percentage of the material to miss the crammers 19 and re-enter the conveyor system on its return side 22. In order to accommodate this design feature without an accumulation of material in inaccessible areas of the conveyor housing 2, a lower stationary belt 23 forces all return material to be carried between the conveyor flights at 24 back to the feed area.

It should be noted that in all figures, the apparatus is represented as having dual conveyor systems so that material may be fed into the system from either side of the truck body. However, in many cases, feeding is done from only a single side of the truck body. In this case, a single conveyor belt system would be used which would simplify the mechanical components of the apparatus as well as increasing the capacity of the material holding bin 5. Two crammers 19 and 19' would be used in a single conveyor system, though baffling would prevent material from traveling outside of the range of the crammer furthest from the conveyor belt.

During operation, it is necessary that the material in the material holding bin 5 be leveled in order to fully utilize the full capacity of said bin. In the one embodiment, an arrangement with an externally actuated paddle 7 is employed which allows the operator to redistribute the load by manipulating an external paddle handle 10. The load condition may be monitored from one or more material sight windows 12. In another embodiment (illustrated in FIG. 6) an open material distribution auger 80, or a series of augers, which are permanently mounted within the material holding bin 5 under the material level, may be driven by the same power train driving the cutter head 1 and related conveyor equipment. In this arrangement, the auger can be used to redistribute the material evenly in the bin.

It should be readily apparent to the trained observer that great care has been taken in the design of this apparatus to provide ease of maintenance. In large part, this has been achieved by using a modular approach with component systems. From FIG. 1 it should be obvious that the entire power section 2 with attached conveyor housing 4 sections can be removed from the material holding bin 5 as an assembled unit, thus, greatly reducing the time required for servicing these areas of the apparatus. It should also be apparent that the removable cutter head 1 assembly will greatly reduce maintenance time and difficulty by allowing removal of the complete cutter head 1 prior to service on the unit. It should also be obvious from FIG. 4 and FIG. 5 that said cutter head assembly may be removed quickly and with little effort due to the simplified cutter head clamp 65 and cutter head locating pin 41 arrangement.

Ease in maintenance has also been assured by using upper conveyor pulley cover plates 42 and a crammer cover plate 44. By means of these cover plates, the respective assemblies may be serviced or removed without the necessity of removing the power section 2 bulkheads 67.

So too, ease of conveyor belt 16 removal has been assured by providing conveyor link pin holes 53 in the power section 2 bulkheads 67 which allow the conveyor belt link pin (not shown) to be removed.

In the preferred embodiment as depicted by FIG. 6, waste material is fed into the feed area 13 wherein the conveyor belt flights 76 sweep the material into the conveying system. The semi-rigid conveyor flight chute 77 in conjunction with the flexible flight member 76*b* entraps the waste material by allowing said flight member and said flight chute to constantly remain in intimate contact irrespective of the size of the conveyed waste material. At the upper limit of conveyor belt 16 travel, the flexible flight member 76*b* has a flinging action which propels the waste material into the crammers 19. The stationary crammer shield 79 prevents any material from inadvertently by-passing said crammers.

The drive train for the undershot conveyor system is similar to that previously described with a chain and sprocket means. However, the chain and sprocket link is between the conveyor belt upper drive pulley 25 and the far crammer 19 shaft which are now rotating in the same direction.

It should also be apparent that thorough care has been exercised in providing an effective safety shut-down system for the conveyor feed. In the event that an operator in any way becomes entangled in the conveyor feed system, any alarm motion against either the crash bar 83 or the door 29 will stop the conveyor. In extreme cases, if the operator became seriously entangled, body weight on the door 29—in conjunction with any motion into said door—would stop the equipment. Further, any obstruction to the opening which would interact with the crash bar 83—such as an operator's arms or shoulders—would stop the equipment.

In some applications, it is desirable to continuously distribute the material within the material holding bin 5 subsequent to size reduction. A material distribution auger 80 mounted under the discharge section of the cutting head 1 accomplishes this task by moving the processed material to the outer walls of the material holding bin 5 from the point at which the said processed material is mounding close to the discharge area of said cutter head.

While the present invention has been described in conjunction with two conveyor embodiments, it is to be understood that various modifications and other embodiments of the present invention may be made without departing from the scope of the invention as described herein and as claimed in the appended claims.

The embodiments of the invention in which an exclusive property or privilege is claimed are defined below.

What I claim is:

1. A vehicle mounted conveying assembly for recycling waste products comprising:

a powered size reduction mechanism, including a removable size reduction head, mounting rails fixed to the vehicle, for said size reduction head which allow horizontal removal of said size reduction head from the assembly;

a powered conveyor mechanism having a conveyor housing, including an infeed area, a discharge area located adjacent and above said size reduction head, and a conveyor belt having conveyor flights spaced therealong for conveying waste products from said infeed area to said discharge area; and drive means, including at least one motor, for powering said size reduction mechanism and said conveyor mechanism; and a personal safety system including a crash bar and door assembly and safety shut down switch, wherein said crash bar and door assembly are constructed and arranged to activate said safety shut down switches when horizontal pressure is applied to said crash bar or to said door, and which is further constructed and arranged to activate said safety shut down switches when vertical pressure is applied to said door when said door is in an open condition;

wherein said conveyor housing is constructed and arranged to be vertically removed from the assembly, independent of said size reduction means.

2. The vehicle mounted conveying assembly of claim 1 further including a rail mounting area for said size reduction head.

3. The vehicle mounted conveying assembly of claim 1 further including a slidably disengaging gear drive between said size reduction head and said drive means.

4. The vehicle mounted conveying assembly of claim 1 further including clamping means to locate said size reduction head in a working position.

5. The vehicle mounted conveying assembly of claim 4 wherein said mounting rails and said clamping means allows interchange of a multiplicity of size reduction heads.

6. The vehicle mounted conveying assembly of claim 1 wherein said infeed area is constructed and arranged to be readily accessible to an operator from a standing position beside the vehicle mounted conveying assembly.

7. The vehicle mounted conveying assembly of claim 1 wherein said conveyor housing further includes a return path for unprocessed material so that said material inadvertently bypassing said size reduction head is returned to said infeed area.

8. The vehicle mounted conveying assembly of claim 1 further including a material holding bin, and a dispersal system for dispersing processed material in said material holding bin.

9. The vehicle mounted conveying assembly of claim 1 which further includes a drive train having gears therein, including a drive module having a hydraulic motor and hydraulic controls which are attached to the conveying assembly as a unit.

10. The vehicle mounted conveying assembly of claim 9 which includes a sliding mount and shim plates and wherein said drive module is positioned relative to any single gear in the drive train by slidably positioning said module in one plane of adjustment and lifting said module with said shim plates for positioning in a second plane of adjustment.

11. The vehicle mounted conveying assembly of claim 1 further including an undershot conveying belt with flights communicating with a flight chute for the purpose of transporting material in a steep incline.

12. The vehicle mounted conveying assembly of claim 11 wherein said conveyor flights have a substantially rigid lower member and a flexible upper member.

13. The vehicle mounted conveying assembly of claim 1 further including a conveying belt with flights communicating with a stationary belt for the purpose of transporting material in a steep incline.

14. The vehicle mounted conveying assembly of claim 13 wherein said stationary belt is tensioned by spring biased tensioning paddles.

* * * * *